US007134907B2

(12) United States Patent
Watanabe et al.

(10) Patent No.: US 7,134,907 B2
(45) Date of Patent: Nov. 14, 2006

(54) CONNECTOR ASSEMBLY HAVING LOW PROFILE

(75) Inventors: Tsuneki Watanabe, Yokohama (JP); Yung-Chien Chung, Tu-Chen (JP)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/173,714

(22) Filed: Jun. 30, 2005

(65) Prior Publication Data

US 2006/0172589 A1 Aug. 3, 2006

(30) Foreign Application Priority Data

Feb. 1, 2005 (CN) ..... 2005 2 0068913

(51) Int. Cl.
*H01R 12/24* (2006.01)

(52) U.S. Cl. ..... 439/495

(58) Field of Classification Search ..... 439/495–497, 439/108, 607, 610, 660
See application file for complete search history.

(56) References Cited

U.S. PATENT DOCUMENTS 5,385,478 A * 1/1995 Niekawa ..... 439/67
5,470,238 A * 11/1995 Walden ..... 439/98
6,692,294 B1 * 2/2004 Kobayashi ..... 439/496
6,830,478 B1 12/2004 Ko

* cited by examiner

*Primary Examiner*—Khiem Nguyen
(74) *Attorney, Agent, or Firm*—Wei Te Chung

(57) ABSTRACT

A connector assembly (1000) comprises a cable end connector (100) soldered with a number of wires (3) and a header connector (200) which is mounted on a motherboard to mate with the cable end connector. The cable end connector comprises a housing (1) receiving a number of contacts (2) therein. The housing defines a first receiving space ( 110*a*) for receiving the header connector and a second space (110*b*) for receiving front ends of the wires. The contacts are located between the first and second spaces, and each having a soldering portion (21) and a contacting portion (22). The soldering portion of each contact has a soldering surface (211) which faces the second space to be electrically connected with corresponding wires and an inner surface (212) which opposite to the soldering surface faces the first space.

19 Claims, 8 Drawing Sheets

CONNECTOR ASSEMBLY HAVING LOW PROFILE

BACKGROUND OF THE INVENTION

1. Field of the Invention

The present invention generally relates to a connector assembly, and more particularly to a micro coaxial connector assembly.

2. Description of the Prior Art

Micro coaxial connector assembly is usually used for connecting a motherboard and a Liquid Crystal Display (LCD). U.S. Pat. No. 6,830,478 B1 discloses a micro coaxial connector assembly comprising a cable end connector and a header connector mounted on the motherboard. The cable end connector includes a first housing receiving a plurality of first contacts, a plurality of wires electrically connecting with the first contacts and a first shield enclosing the first housing. The header connector includes a second housing receiving a plurality of second contacts, a second shield enclosing the second housing. The first contacts respectively electrically connect with the second contacts to form electrical connection between the cable end connector and the head connector.

It is current trend to make connectors with low profile, minimized size and low cost. Therefore, in order to increase production efficiency and facilitate assembly of the micro coaxial connector assembly mentioned above, it is tried by manufacturers to design simpler structure within a limited space and manufacture the connector at lower cost while achieving more precisely electric connection.

BRIEF SUMMARY OF THE INVENTION

Accordingly, an object of the present invention is to provide an improved connector assembly, the occupied space of the connector assembly in a chassis of a device effectively reduced.

In order to achieve the object set forth, a connector assembly in accordance with the present invention comprises a cable end connector soldered with a plurality of wires and a header connector which is mounted on a motherboard to mate with the cable end connector. The cable end connector comprises a housing receiving a plurality of contacts therein. The housing defines a first receiving space for receiving the header connector and a second space for receiving front ends of the wires. The contacts are located between the first and second spaces, and each having a soldering portion and a contacting portion. The soldering portion of each contact has a soldering surface which faces the second space to be electrically connected with corresponding wires and an inner surface which opposite to the soldering surface faces the first space.

Other objects, advantages and novel features of the invention will become more apparent from the following detailed description when taken in conjunction with the accompanying drawings.

DETAILED DESCRIPTION OF THE PREFERRED EMBODIMENT

Reference will mow be made in detail to the preferred embodiment of the present invention.

Figure 1:
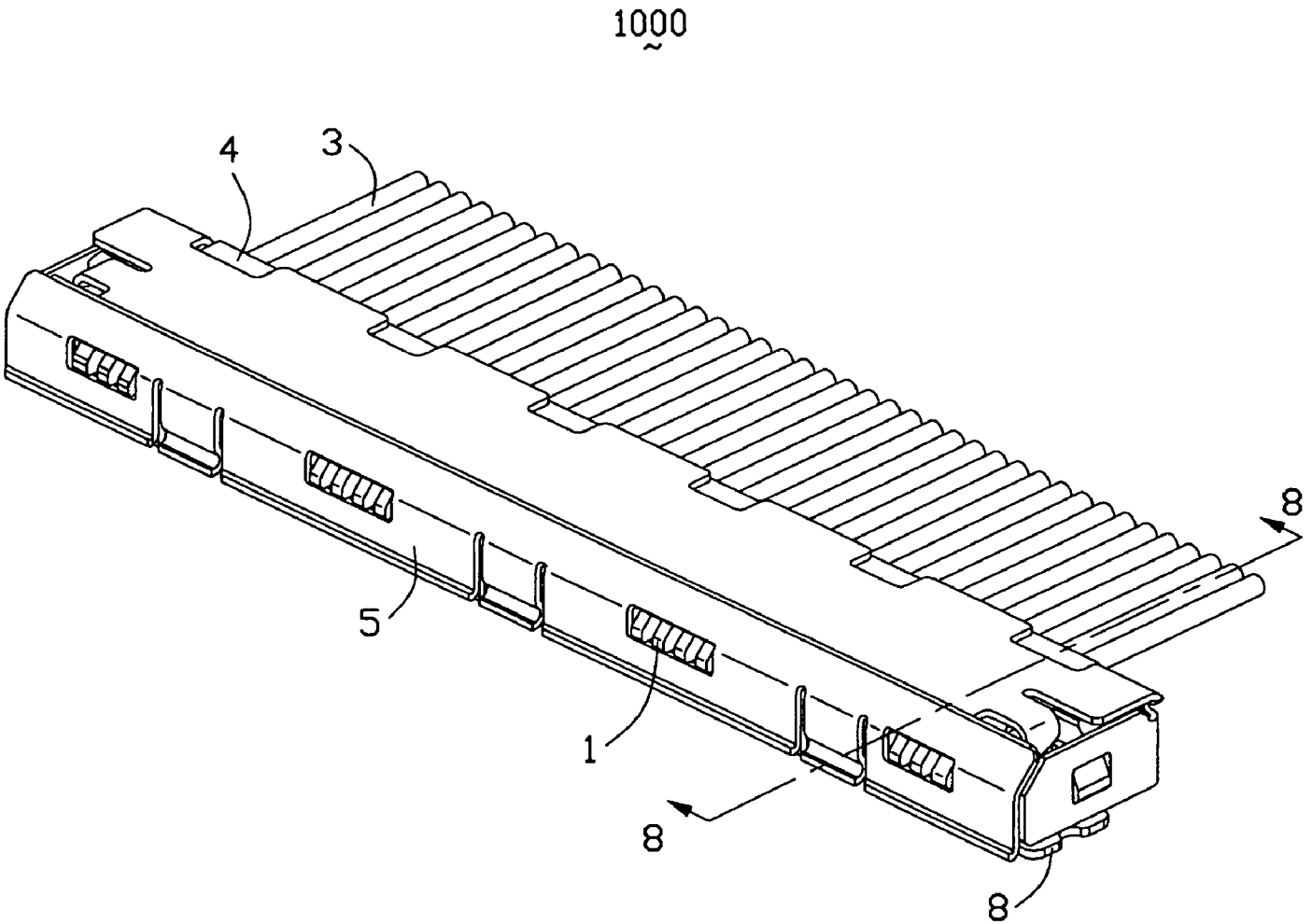
FIG. 1 is an assembled, perspective view of a connector assembly according to the present invention.
Figure 2:
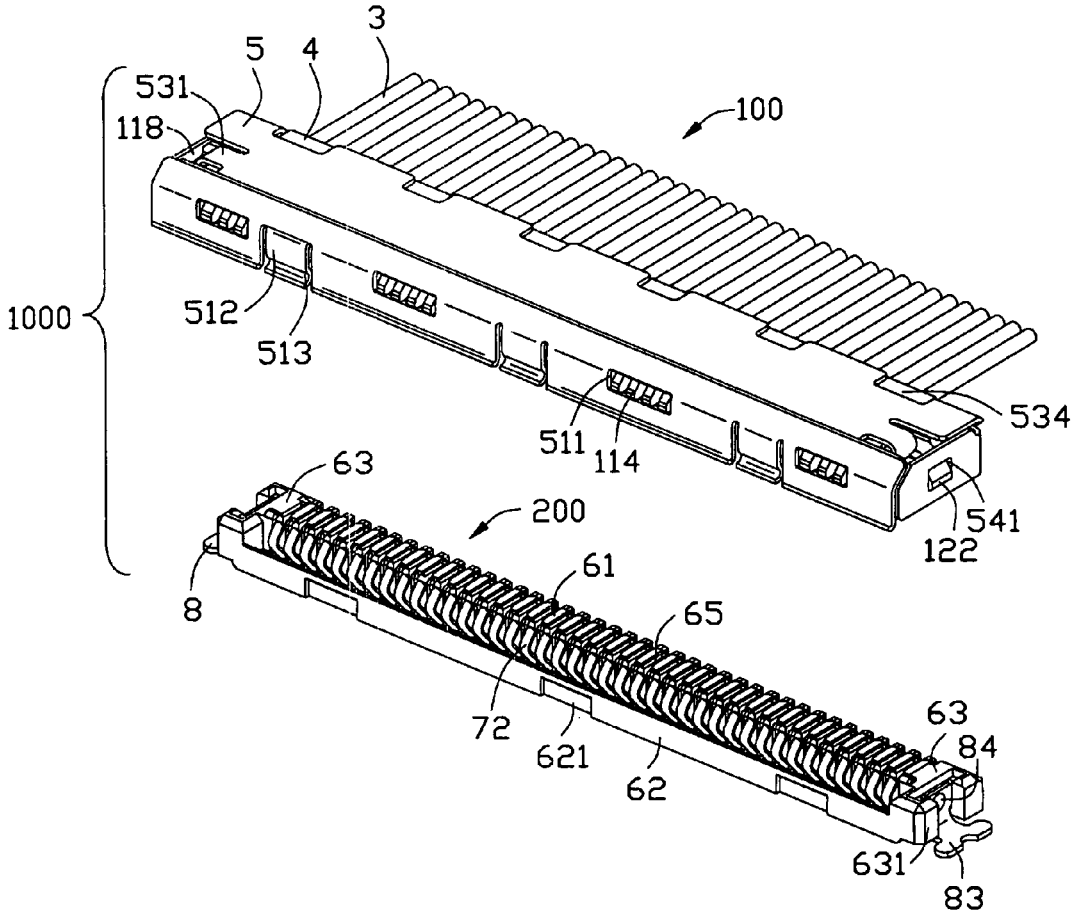
FIG. 2 is a partially exploded, perspective view of the connector assembly of FIG. 1, wherein the connector assembly includes a cable end connector and a header connector.
Figure 3:
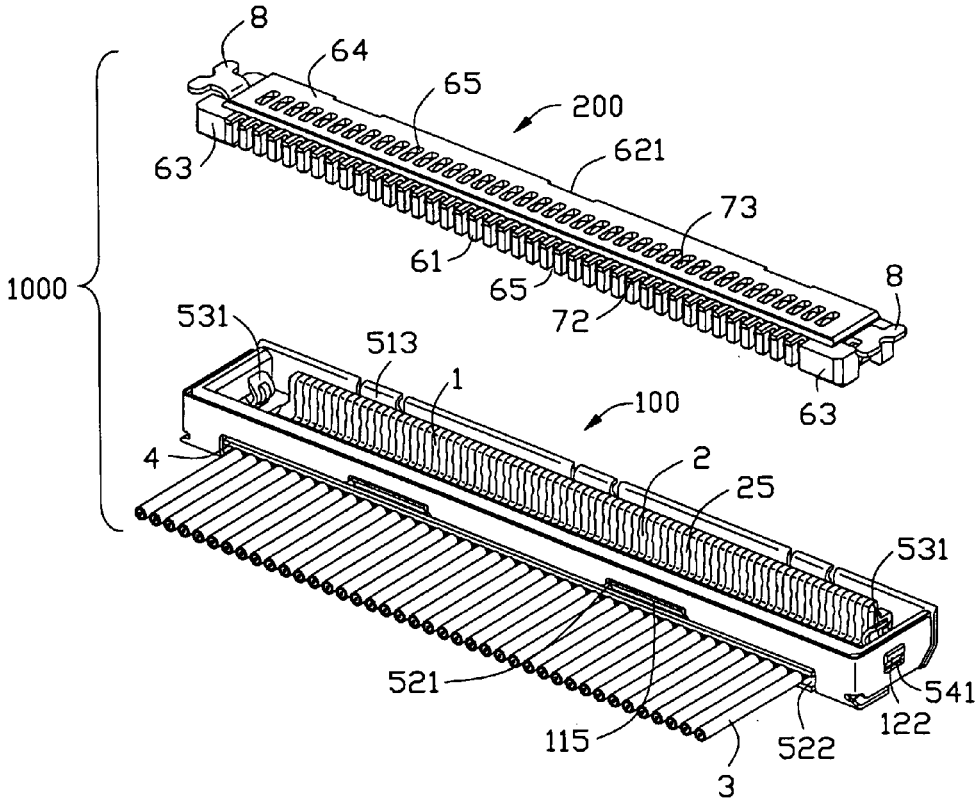
FIG. 3 is a view similar to FIG. 2, but taken from a different aspect.

Referring to FIGS. 1–3, a connector assembly (a low-profile electrical interconnection) 1000, namely a micro coaxial connector assembly, in accordance with the present invention includes a cable end connector (a first connector) 100 and a header connector (a second connector) 200 mounted on a motherboard (not shown).

Figure 4:
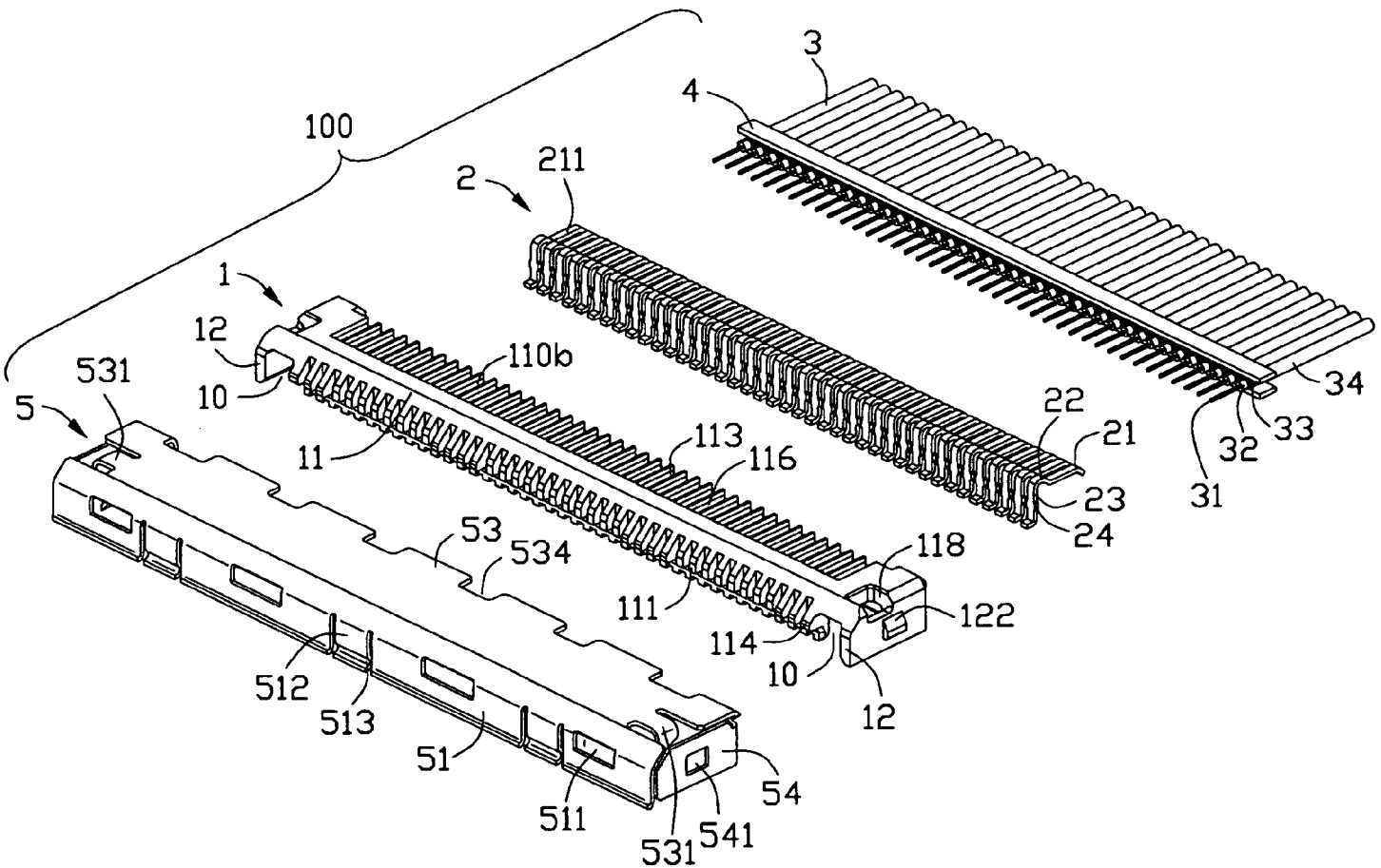
FIG. 4 is an exploded, perspective view of the cable end connector shown in FIG. 2.
Figure 5:
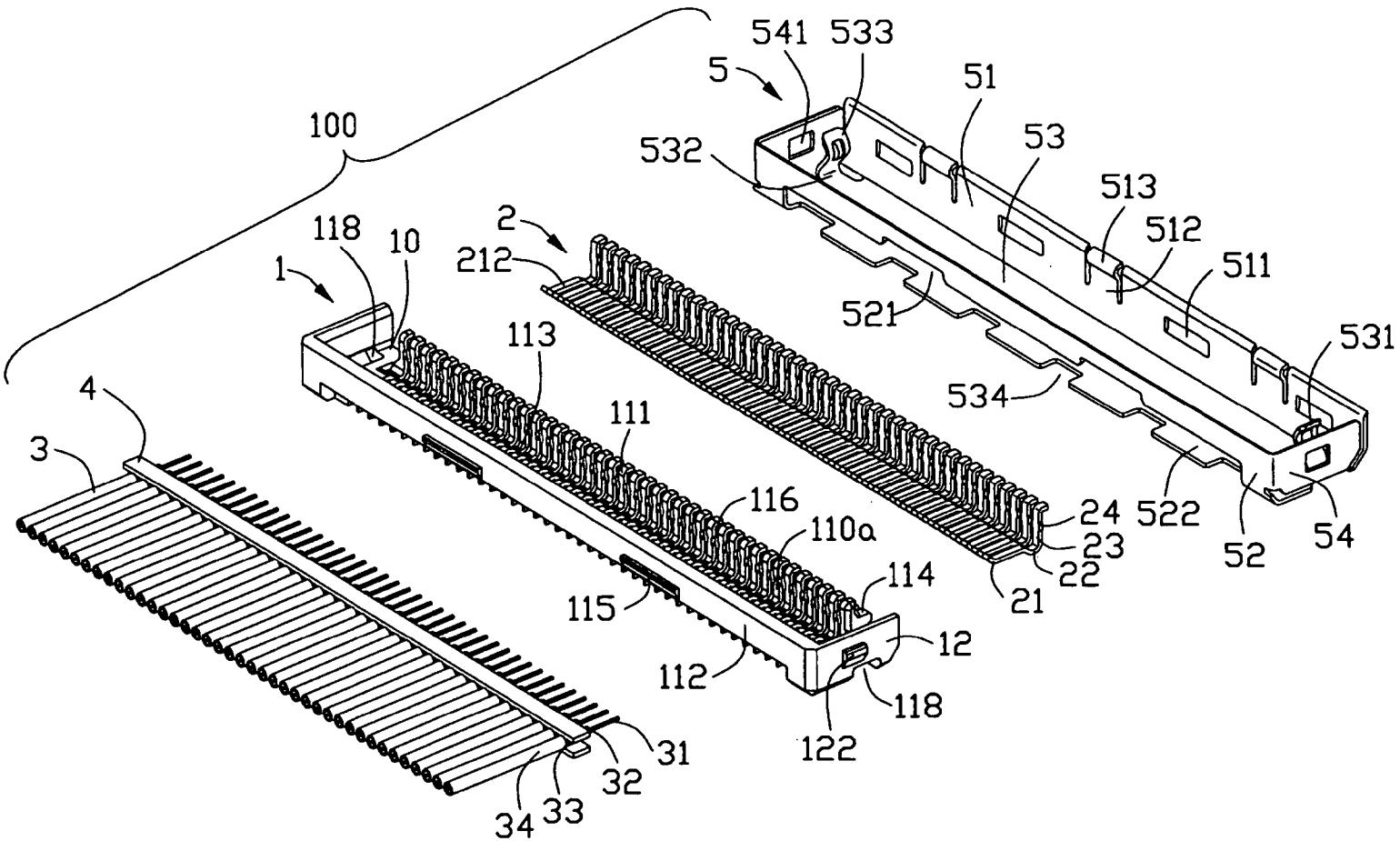
FIG. 5 is a view similar to FIG. 4, but taken from a different aspect.

Referring to FIGS. 4 and 5 in conjunction with FIGS. 2 and 3, the cable end connector 100 includes a first housing 1 receiving a plurality of first contacts 2, a plurality of wires 3 electrically connected with the first contacts 2, a pair of grounding members 4 and a shield 5.

Figure 8:
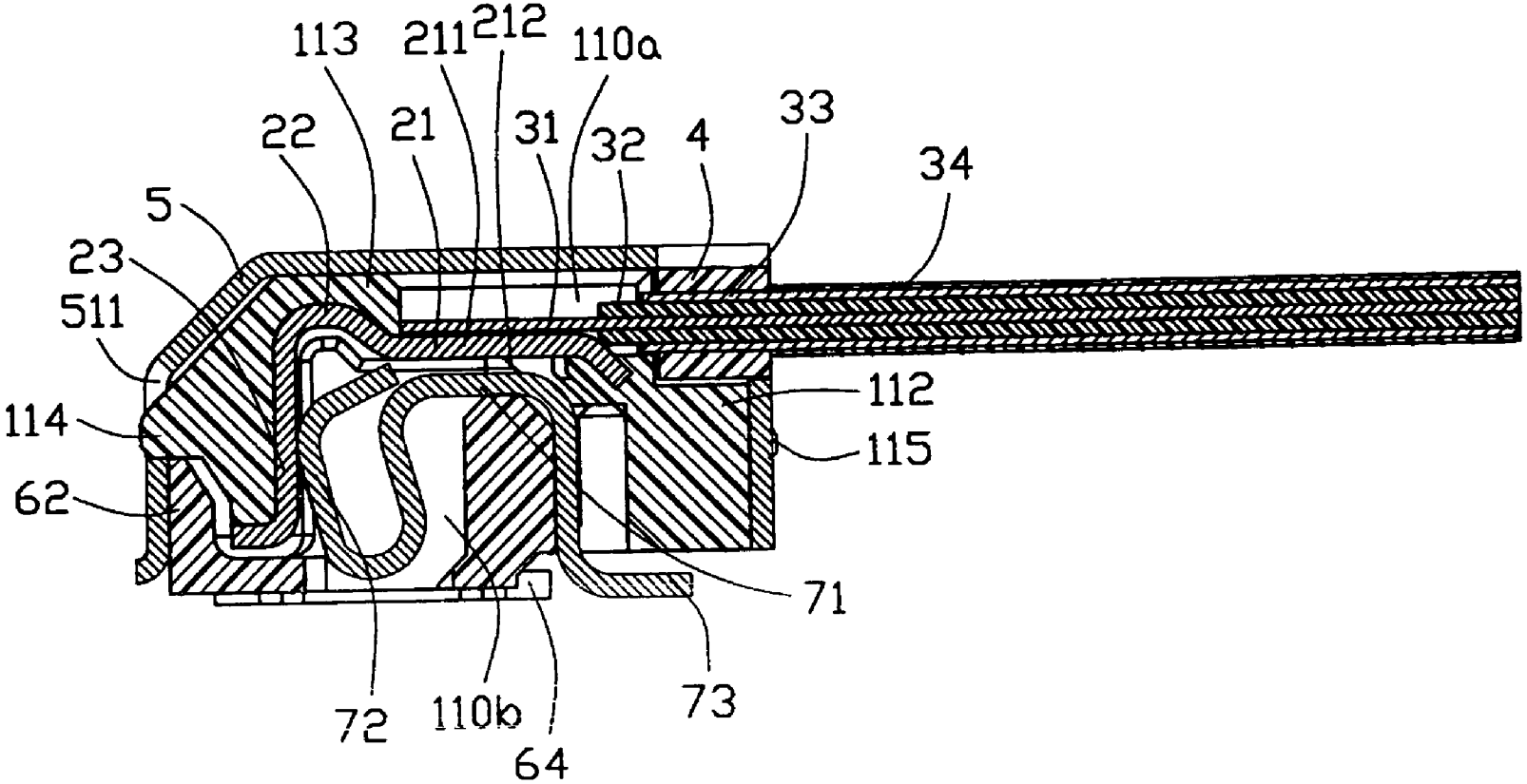
FIG. 8 is a cross-sectional view taken along line 8—8 of FIG. 1.

Referring to FIGS. 4 and 5 in conjunction with FIG. 8, the first housing 1 is substantially elongated and includes a U-shaped longitudinal main body 11, a pair of arms 12 formed on opposite sides of the main body 11, and a pair of intervals 10 defined between the main body 11 and the arms 12. The main body 11 includes a front wall 111, a rear wall 112 and a top wall 113 connecting the front and the rear walls 111, 112. The first housing 1 has a first receiving space 110*a* surrounded by the front, rear and top walls 111, 112, 113 for receiving the header connector 200, spaced first passageways 116 arranged in line in the inner sides of the front and top walls 111, 113 and a second receiving space 110*b* defined in outer side of the top wall 113 for receiving front ends of the wires 3. The first and second receiving spaces 110*a*, 110*b* communicate with each other through the first passageways 116 which are defined at the top wall 113. Furthermore, two notches 118 are defined in the top wall 113 and extend downwardly to communicate with corresponding intervals 10. A plurality of projections 114, 115, 122 are additionally formed on the periphery of outer sides of the front wall 111, the rear wall 112 and the opposite arms 12 to cooperate with the shield 5.

The first contacts 2 are received in the first passageways 116 of the first housing 1. Each contact 2 is substantially L-shaped, having a generally horizontally extending soldering portion 21, a generally vertically extending contacting portion 23, an extrusion 22 between the soldering portion 21 and the contacting portion 23, and a pair of first barbs 24 extending outwardly from the contacting portion 23. The soldering portions 21 are disposed in the first passageways 116 defined in the top wall 113, in other word, located between the first and second receiving spaces 110*a*, 110*b* of the first housing 1, while the contacting portions 23 are disposed in the first passageways 116 defined in the front wall 111, and by means of the first barbs 24, the first contacts 2 are in a fix position. It is noted that the soldering portion 21 has a soldering surface 211 and an opposite inner surface 212. The inner surface 212 directly faces the first receiving space 110*a*, while the soldering surface 211 directly faces the second receiving space 110*b*. In addition, the first contacts 2 also can be insert-molded with the first housing 1.

The wires 3 are arranged side by side and each, from inner to outer, includes a center conductor 31, an inner insulation 32, a braided wire shield 33 and an outer sheath 34. The grounding members 4, which are a pair of elongated metal plates, respectively solder to the braided wire shields 33 of the wires 3.

The shield 5 integrally stamped from a metal piece encloses the first housing 1 with antimagnetic function. The shield 5 includes a front plate 51, a rear plate 52, a top pate 53 connecting the front and rear plates 51, 52 and a pair of side plates 54 extending from opposite sides of the rear plate 52. Corresponding to the projections 114, 115, 122 of the first housing 1, the front, rear and side plates 51, 52, 54 respectively define openings 511, 521, 541 to suit therewith. The front plate 51 is stamped to form a plurality of blades 512 each having a retention portion 513 at free end thereof. The rear plate 52 defines an elongated aperture 522 communicating with the openings 521 and further extending to define a plurality of spaced cutouts 534 at the top plate 53. Before assembling the shield 5 to the first housing 1, the bus of wires 3 with the grounding members 4 go through the aperture 522. The front ends of the wires 3 enter into the second receiving space 110*b* of the first housing 1 with the center conductors 31 soldered to corresponding soldering surfaces 211 of the first contacts 2 to electrically connect therewith. Then, the shield 5 is moved above the first body 1 and attached around the first body 1 through the openings 511, 521, 541 of the shield 5 engaging with the projections 114, 115, 122 of the first housing 1. Furthermore, a pair of S-shaped fingers 531 extends downwardly and resiliently from the top plate 53, which are located between and proximate to the side plates 54. Upper portions (not labeled) of the fingers 531 are positioned in the notches 118 of the first housing 1, while lower portions 533 of the fingers 531 go through the through holes 118 and finally be positioned in the intervals 10 to cooperate with the header connector 200.

Figure 6:
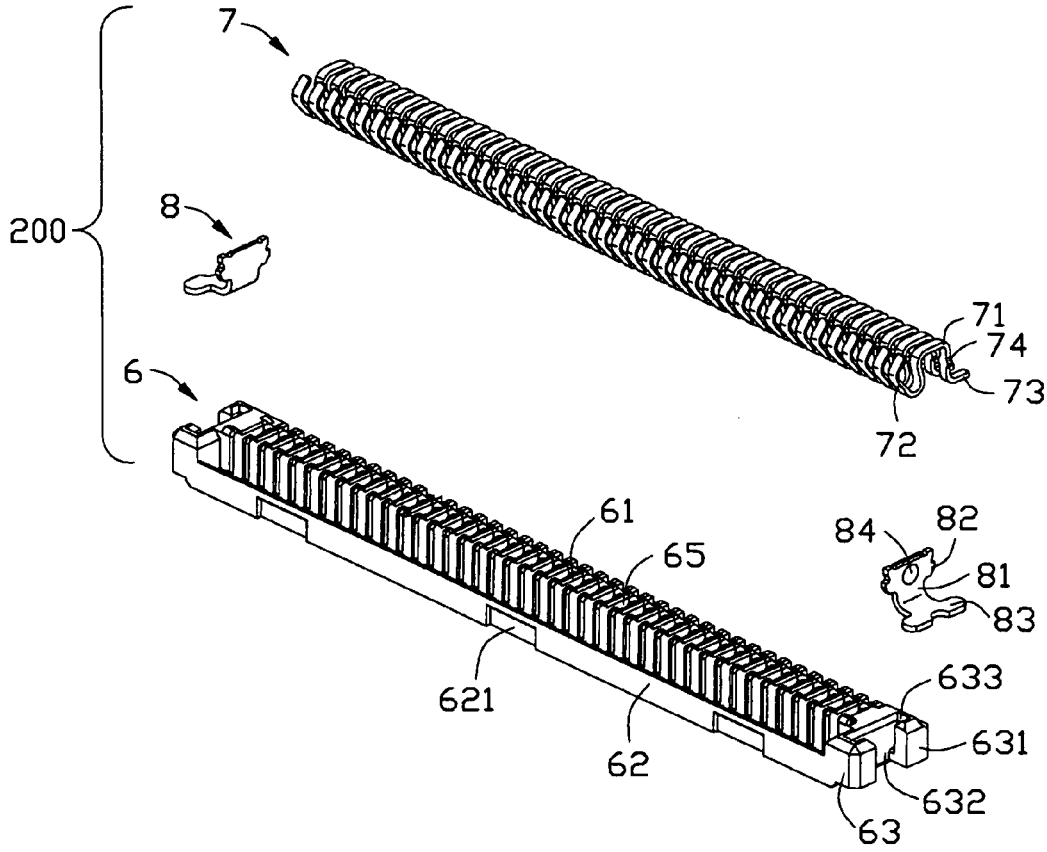
FIG. 6 is an exploded, perspective view of the header connector shown in FIG. 2.
Figure 7:
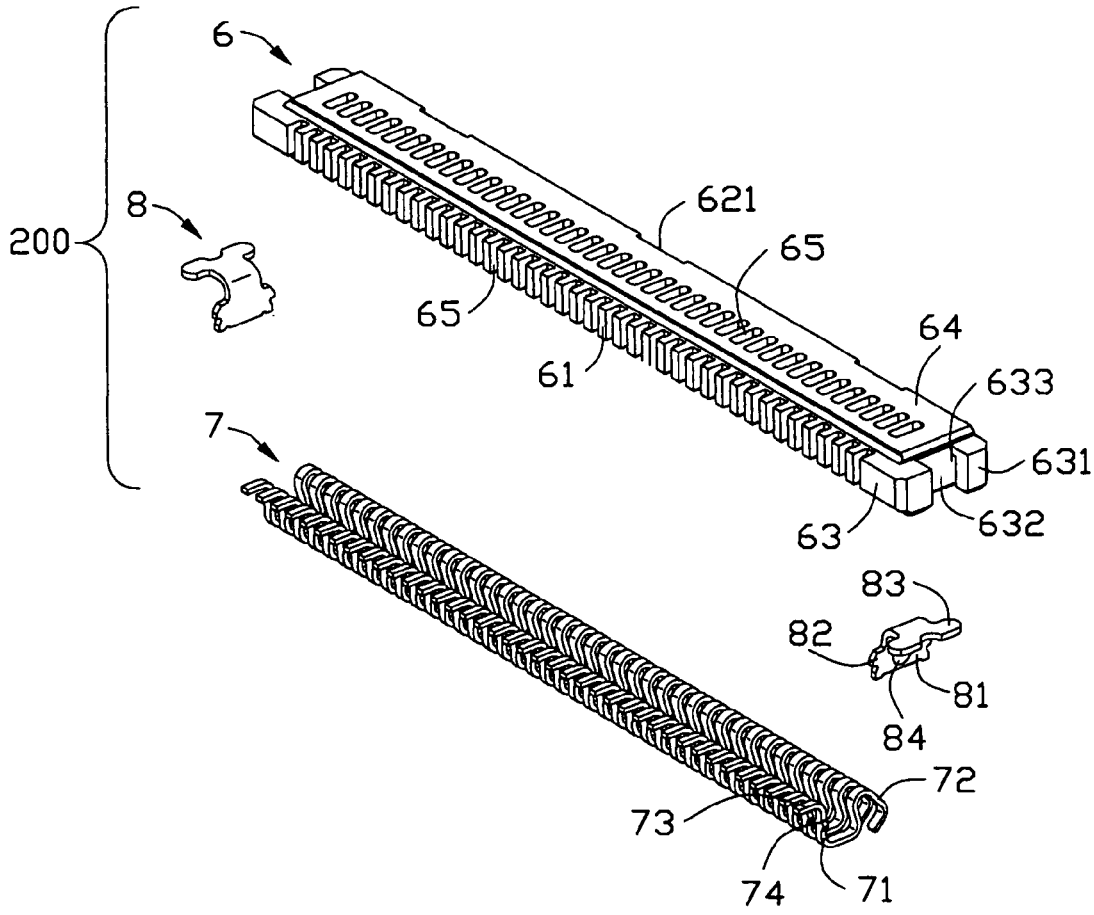
FIG. 7 is a view similar to FIG. 6, but taken from a different aspect.

Referring to FIGS. 6 and 7 in conjunction with FIGS. 2 and 3, the header connector 200 includes a second housing 6 receiving a plurality of second contacts 7 and a pair of grounding plates 8.

Referring to FIGS. 4–8, the second housing 6 is also elongated and includes a base 62, a mating portion 61 projecting from the base 62, a pair of joints 63 longitudinally spaced by the mating portion 61 and a standoff 64 extending downwardly from front region of the base 62. A plurality of recesses 621 inward extend from periphery of front side of the base 62. A plurality of second passageways 65 are defined in the mating portion 61 and parallelly arranged in line along a longitudinal direction of the housing 6. Two ends of each joint 63 are symmetrically formed with two pillars 631 along a front-to-back direction perpendicular to the longitudinal direction and accordingly a T-shaped space 632 is defined between the pillars 631.

The second contacts 7 are received in the second housing 6 from a bottom of the second housing 6 and each includes a n-shaped middle portion 71 with a pair of second barbs 74, a generally vertically arranged V-shaped engaging portion 72 extending from front end of the middle portion 71, and a tail 73 horizontally extending from rear end of the middle portion 71. The n-shaped middle portions 71 are fitly disposed in the second passageways 65 of the second housing 6, while the engaging portions 72 and the tails 73 are respectively exposed outside from the mating portion 61 of the second housing 6. Similarly, by means of the second barbs 74, the second contacts 7 are embedded in the second housing 6 in a fix position.

The grounding plates 8 are generally L-shaped and each includes a vertical portion 81, a bifurcated horizontal portion 83, a pair of ears 82 extending from opposite sides of the vertical portion 81, and a round depression 84 depressed in central region of the vertical portion 81. The ears 82 interfere with the inner sides of the pillars 631 for assembling the grounding plates 8 to the second housing 6 from the bottom of the second housing 6. The bifurcated horizontal portions 83 extend beyond the T-shaped space 632 for soldering with the motherboard.

Referring to FIGS. 1–8, in assembling of the connector assembly 1000, the cable end connector 100 mates with the header connector 200 along the mating direction. The mating portion 61 of the header connector 200 is received in the first receiving space 110*a* of the cable connector 100 and the joints 63 enter into the intervals 10 such that the engaging portions 72 of the second contacts 7 are electrically coupled with corresponding contacting portions 22 of the first contacts 2. The shield 5 of the cable end connector 100 encloses the second housing 6 of the header connector 200 with the retention portions 513 of the blades 512 engaged in the recesses 621 of the base 62, and wherein the grounding finger 531 of the shied 5 is electrically connected with the depression 84 of the grounding tab 8 of the header connector 200, so the shield 5 can substantially encloses the header connector 200 for reducing the height of the connector assembly 1000.

It is to be understood, however, that even though numerous, characteristics and advantages of the present invention have been set fourth in the foregoing description, together with details of the structure and function of the invention, the disclosed is illustrative only, and changes may be made in detail, especially in matters of shape, size, and arrangement of parts within the principles of the invention to the full extent indicated by the broad general meaning of the terms in which the appended claims are expressed.

What is claimed is:

1. A low-profile electrical interconnection, comprising:

a first connector having a first housing with a first elongated body defining a receiving space;

a plurality of first contacts arranged in the first body;

a shield enclosing the first connector, and having at least a grounding finger extending inward therefrom; and a second connector having a second insulative housing with a second elongated body and a plurality of second passageways arranged on the body received in said receiving space of the first connector;

a plurality of second contacts received in the passageways of the second housing and intermatable with the first contacts; and at least one ground tab arranged in longitudinal ends of the body and electrically interconnected with the at least one grounding finger of the shield of the first connector.

2. The low-profile electrical interconnection according to claim 1, wherein the first connector further comprises a cable having a plurality of wires, and wherein the first contacts are respectively soldered with the wires of the cable.

3. The low-profile electrical interconnection according to claim 2, wherein the wires have at least one grounding member, and wherein the wires further have braided wire shields which are electrically connected together through the at least one grounding member.

4. The low-profile electrical interconnection according to claim 2, wherein the first body defines a second receiving space to receive front ends of the wires so as to make corresponding conductors of the wires soldered with the first contacts.

5. The low-profile electrical interconnection according to claim 2, wherein the shield defines an elongated aperture for permitting the wires to go trough.

6. The low-profile electrical interconnection according to claim 2, wherein the receiving space of the first connector defines a first receiving space for receiving the second connector and a second space for receiving front ends of the wires.

7. The low-profile electrical interconnection according to claim 6, wherein the first contact of the first connector has a soldering portion having a soldering surface which faces the second space to be electrically connected with corresponding wires and an inner surface which opposite to the soldering portion which faces the first space.

8. The low-profile electrical interconnection according to claim 1, wherein the receiving space of the first connector substantially encloses the second connector for reducing the height of the connector assembly.

9. The low-profile electrical interconnection according to claim 1, wherein the first contacts of the first connector are insert-molded with the first elongated body.

10. The low-profile electrical interconnection according to claim 1, the first contact of the first connector encloses corresponding second contact of the second connector approximately.

11. The low-profile electrical interconnection according to claim 1, wherein the first body of the first connector has at least one notch, the at least one finger of the shield is accordingly positioned in corresponding notches.

12. The low-profile electrical interconnection according to claim 1, wherein the at least one grounding tab includes a vertical portion, a horizontal portion and a depression from opposite sides of the vertical portion.

13. The low-profile electrical interconnection according to claim 1, wherein a pair of arms are formed on opposite sides of the first body, the second body is located between the arms of the first body.

14. An electrical connector comprising:

a first having a first connector having a first housing with a first body defining a first receiving space between two opposite elongated first side walls;

a plurality of first contacts disposed in the first housing with a first contact portion exposed to the first receiving space;

a first metallic shield enclosing said first housing and leaving a second receiving space between the metallic shield and one side wall; and a second connector having a second insulative housing with a second elongated body defining a third receiving space between two opposite elongated second side walls; and a plurality of second contacts disposed in the second housing with a second contact portion exposed in the third receiving space; wherein one second side wall with the second contacts of said second connector is received in the first receiving space under a condition that said second contacts engage the corresponding first contacts, respectively, and the other second side wall is received in the second receiving space.

15. The connector assembly as claimed in claim 14, wherein said second contact portion defines a resilient structure to impose a force upon the corresponding first contact portion in a transverse direction perpendicular to a longitudinal direction of the connector assembly.

16. The connector assembly as claimed in claim 14, wherein said first connector further includes a plurality of wires connected to the corresponding first contacts, respectively.

17. The connector assembly as claimed in claim 16, wherein said first contact further defines a solder portion to mechanically and electrically connected to the corresponding wire, and a curved portion is located between the first contact portion and the solder portion.

18. The connector assembly as claimed in claim 14, wherein the first connector is assembled to the second connector in a vertical direction under a condition that the first contact and the second contact not only electrically and mechanically engage each other in a horizontal direction but also directly face to each other in a vertical direction without either said first housing or said second housing blocking therebetween so as to obtain a low profile thereof.

19. A low-profile electrical interconnection, comprising:

a first connector having a first housing with a first elongated body defining a receiving space;

a plurality of first contacts arranged in the first body;

a shield enclosing the first connector, and having at least a grounding finger extending inward therefrom; and a second connector having a second insulative housing with a second elongated body and a plurality of second passageways arranged on the body received in said receiving space of the first connector;

a plurality of second contacts received in the passageways of the second housing and intermatable with the first contacts; and at least one ground tab arranged in longitudinal ends of the body and electrically interconnected wit the at least one grounding finger of the shield of the first connector;

wherein the second housing of the second connector defines a T-shaped space in each end thereof, and the grounding finger of the first connector is received in the T-shaped space and electrically connected with a depression of the grounding tab.

* * * * *